United States Patent [19]

Hartman

[11] 4,249,956

[45] Feb. 10, 1981

[54] METHOD OF REMOVING PAINT FROM A BRICK SURFACE

[76] Inventor: Charles N. Hartman, 944 Algonquin Rd., Niskayuna, N.Y. 12309

[21] Appl. No.: 62,735

[22] Filed: Aug. 1, 1979

[51] Int. Cl.[3] ..... B08B 7/00; B24C 1/00

[52] U.S. Cl. ..... 134/7; 51/321; 51/427; 134/38

[58] Field of Search ..... 134/7, 36, 38; 51/319, 51/321, 427, 436

[56] References Cited

U.S. PATENT DOCUMENTS

| | | | |
|---|---|---|---|
| 2,040,715 | 5/1936 | Smith | 51/321 |
| 2,583,779 | 1/1952 | Jones | 134/38 X |
| 2,669,809 | 2/1954 | McGrath | 134/7 UX |
| 2,742,738 | 4/1956 | Hall | 51/427 |
| 2,768,101 | 10/1956 | Fairchild | 134/38 X |
| 3,427,763 | 2/1969 | Maasberg et al. | 51/321 |
| 3,791,078 | 2/1974 | Fleisher | 51/436 X |
| 3,828,478 | 8/1974 | Bemis | 51/427 |
| 3,858,358 | 1/1975 | Stachowiak et al. | 51/427 |
| 3,972,150 | 8/1976 | Hart | 51/427 X |
| 3,994,097 | 11/1976 | Lamb | 51/427 |
| 4,125,969 | 11/1978 | Easton | 51/321 X |

*Primary Examiner*—Marc L. Caroff

*Attorney, Agent, or Firm*—Heslin, Irwin & Nieman

[57] ABSTRACT

Paint is removed from brick work without destroying the dense, protective outer surface portion of the bricks by first scraping away heat-loosened paint and then lightly etching the brick surface to remove uniformly the paint residue by combined action of a high-velocity water stream and a relatively low-velocity, smaller stream of granular abrasive material directed at an angle into the water stream. The concentration of abrasive particles entrained in the water stream is varied while directing the water stream against the brick surface by moving the nozzle delivering the abrasive material stream closer to or farther from the water stream.

6 Claims, 5 Drawing Figures

METHOD OF REMOVING PAINT FROM A BRICK SURFACE

The present invention relates generally to the art of brick work cleaning and is more particularly concerned with a novel method of removing paint and the like from brick surfaces without damaging them, and is also concerned with the new lightly etched brick products resulting from that process.

BACKGROUND OF THE INVENTION

Paint can be removed from the surfaces of masonry structures in a variety of ways. Thus, brushing and scrubbing manually, steam cleaning, burning, chemical cleaning and sandblasting have all been used over the years with varying degrees of success. While chemical cleaning and sandblasting are consistently the most effective methods, they are also by far the most destructive, particularly as applied to brick work. The bricks of commerce are kiln-fired, pressed clay products which, in their mint condition on emerging from the kiln, have a bisque or enamel coating covering a porous pulp or interior structure comprising the main mass of the body of the brick. In the chemical cleaning operation, paint is removed but the chemicals etch, as well as dissolve, the surface of the brick exposing the pulp-like, porous interior structure. Further, the chemicals form silica salts with the brick structure which are absorbed by the pulp of the brick only to bleed outside on the surface of the brick after the job has been finished for some time. The brick is also weakened structurally by such chemical action so that the physical integrity of the structure as well as its aesthetic character is somewhat diminished. Sandblasting, on the other hand, results in destruction of the exterior surface or bisque which is completely eroded away, leaving the weaker pulp of the brick mass exposed. Again, the structure of the brick is weakened and the brick is exposed to rapid weathering action by the elements and corrosive air pollution components.

As a general proposition, the alternative to using these paint removing processes is to leave the paint in place on the exterior surface of a brick wall of a building, but experience has shown that this is not practicable for other reasons. Thus, even though the paint is initially attractive in appearance, it promotes breakdown and is otherwise detrimental, particularly in those buildings where there is no wall insulation or vapor barrier, as is generally the case in historical buildings. This is because the paint coating acts as a barrier to the dissipation of water vapor that develops inside buildings and this moisture is trapped within the pores of the brick so that during freeze/thaw cycles it causes spalling of the brick exterior surfaces. In addition, by blocking dissipation of moisture, the paint coating results in increased humidity within the structure causing decay of lumber and other biodegradable components in the walls, peeling of the paint on the inside surface and excessive condensation and consequent physical discomfort of building occupants.

SUMMARY OF THE INVENTION

The foregoing shortcomings of the prior art can be avoided and certain new advantages and results can be obtained in accordance with the present invention which centers in my novel pressure-grit washing concept and is based on my new discoveries to be described. Thus, I have found that single and multiple layers of paints of all types and kinds can be removed completely from brick surfaces without destroying the protective bisque or enamel of the brick. Further, I have found that such removal can be accomplished at a rate and a cost which are competitive with the best techniques known heretofore. Still further, I have found that particularly in the case where several layers of paint are to be removed, the process can be expedited by heating the paint without igniting it and then scraping off the heat-loosened paint before it can cool and become rebonded to the substrate.

Pressure grit washing as I have conceived it, involves the use of a high-velocity stream of water and a separate, relatively low-pressure, smaller stream of abrasive material. The water stream is directed against the paint-bearing brick surface and the stream of abrasive material is directed into the water stream at an angle to the direction of flow thereof so that the particulate material is entrained in the water and delivered in dispersion against the paint to be removed. Also, according to this concept, the concentration of the dispersion on the painted area of impact can be increased or diminished by moving the nozzle delivering the abrasive material spray closer to or farther from the water spray. However, I found that regardless of the proximity of that nozzle to the water spray and regardless of the angular relationship between the two sprays, the operator can visually follow the course of the cleaning operation and consequently avoid etching any part of the bisque of the brick more deeply than necessary to remove the last of the adhering paint. Thus, the entire surface of each brick of a brick work structure can be substantially uniformly lightly etched so that the bisque is left intact without any opening into the pulp of the interior structure of the brick.

As indicated, there is in accordance with this invention a dimensional relationship between the two streams which is important. By maintaining water volume greater than that of the abrasive material at the brick surface, the water buffers or cushions the solids spray and totally suppresses the sandblasting effect of it without preventing its cutting action which depends importantly upon the proportions of grit and water at the brick surfaces, as will be more fully described below.

Described in brief, then, the process of this invention comprises the steps of directing a stream of water at high velocity against the paint still adhering to the brick, directing a relatively low velocity stream of fine particle abrasive material into the high pressure water stream at an angle from 30° to 90° to the longitudinal axis of the water stream, and removing the water stream from contact with the brick surface substantially as soon as the paint has all been removed from that surface. In usual preferred practice, this process includes, in addition, preliminary steps of heating and oxidizing paint on the brick surface without igniting it and then scraping off paint loosened by the heating step.

Similarly briefly described in product terms, this invention consists of a kiln-fired, pressed clay brick having a relatively thin bisque surface portion and a relatively less dense, porous interior portion, the bisque surface portion being of approximately uniform thickness substantially less than the initial thickness of the bisque surface portion and having an exposed, substantially uniformly etched surface free from discontinuities.

Otherwise briefly described, the product of this invention is brick work of kiln-dried bricks cleaned of paint by the process of claim 1 in which each brick of the masonry structure having an exposed paint-free bisque surface uniformly etched and free from discontinuities opening into the interior surface of the brick.

BRIEF DESCRIPTION OF THE DRAWINGS

Those skilled in the art will gain a further and better understanding of this invention from the drawings accompanying and forming part of the specifications, in which.

DETAILED DESCRIPTION OF THE INVENTION

Figure 1:
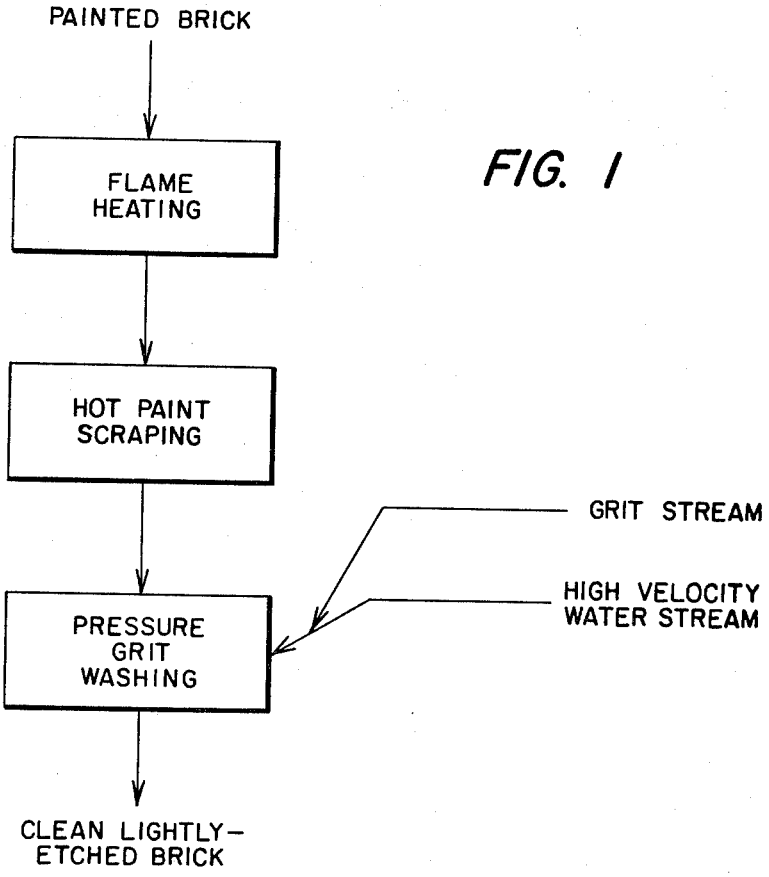
FIG. 1 is a flow sheet illustrating the process of this invention.

As generally described above and illustrated in FIG. 1, the process of this invention is applied to individual bricks as well as to constructions of brick work and brick walls and, in any event, there is no preliminary preparation of the surface that is required and the process may be begun satisfactorily with the heating step resulting in oxidation without ignition of the paint. In carrying out this step, I prefer the use of propane and, using a torch of conventional design and applying the flame directly to the paint on the brick until it is blistered and turns black. Then, just before the burned paint begins to turn white, the torch is removed and the heating process is discontinued. Preferably, at that point and before the paint has had an opportunity to cool, I remove the paint loosened by the heating by scraping the brick. This can be done to advantage through use of a manually applied scraper of conventional type. As a special note of caution, at this optional, preliminary stage of the process, care should be exercised to discontinue the application of the flame to the brick so as to avoid cracking or scorching it and this result will be obtained if the timing of the removal of the flame is in strict conformance with the instructions set out just above.

Figure 5:
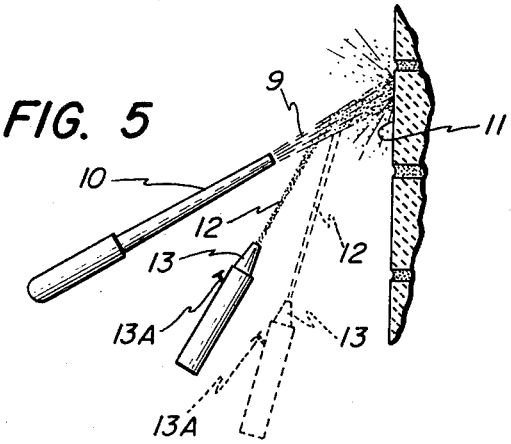
FIG. 5 is a fragmentary elevational view of brick work to which the process of this invention is being applied, water and grit stream nozzles being shown in alternative preferred relative positions.

As the principal step of the process and the one in which novelty centers, a high-pressure water blast is directed as a high-velocity stream against the painted surface to remove the paint adhering following the scraping operation. As shown in FIG. 5, a 1200 to 1500 pounds per square inch (psi) pressure water source is used to generate the stream 9 through nozzle 10 positioned in proximity to brick 11 to be cleaned and will serve to remove the paint loosened but not taken away by the scraping operation. Then, at that point or initially when the water pressure is first applied, a second spray 12 of abrasive particulate material delivered at nozzle pressure of 60 to 90 psi is directed toward the brick but at an angle to the water stream of from 30° to 90°. Nozzle 13 delivering the particulate material may be placed close to the water stream or it may be removed some distance therefrom, depending upon the nature of the paint film or coating to be removed and also upon the hardness of the brick surface being cleaned. The concentration, and consequently the cutting effect, of the suspension of particulate material in the high-pressure water spray will be determined by the relative volumes of the sprays, that is, the relative sizes of the streams. The concentration of the suspension will also depend upon the relative positions of the particulate spray nozzle to the water spray, the nearer that nozzle is to the spray the greater the cutting action at the brick surface spray impact area. It is my preference in carrying out this phase of the process that the two nozzles be manipulated by one operator who can readily follow the process visually and make necessary adjustments in the relative positions of the spray sources to accomplish the paint removal efficiently and rapidly without removing too much of the bisque from any part of the brick and thereby destroying the beneficial and protective effect which that component of the brick has upon the overall integrity of the brick and the masonry incorporating it. I have found that optimum results will be obtained in this pressure grit washing process when water spray nozzle 10 is within a foot or so of the brick surface to be cleaned and particulate spray nozzle 13 is six (6Δ) inches to one foot away from water spray 9 and at a point intermediate between nozzle 10 and brick 11. As also indicated in FIG. 5, the positions of the nozzles and their relative positions to the brick surface being pressure grit washed may vary somewhat with various brick materials and coatings, but, generally, the variations in this respect will be of the order of one-half foot to less. Also, the angle at which particulate spray 12 is directed into water stream 9 is largely a matter of operator convenience and choice as there is not a substantial difference in the cutting action or paint removing action so long as the particle spray is directed at an angle to the water spray from 30° to 90°. An angle of approximately 45° is an example of an angle that can be used for all around good performance of the invention.

Figure 2:
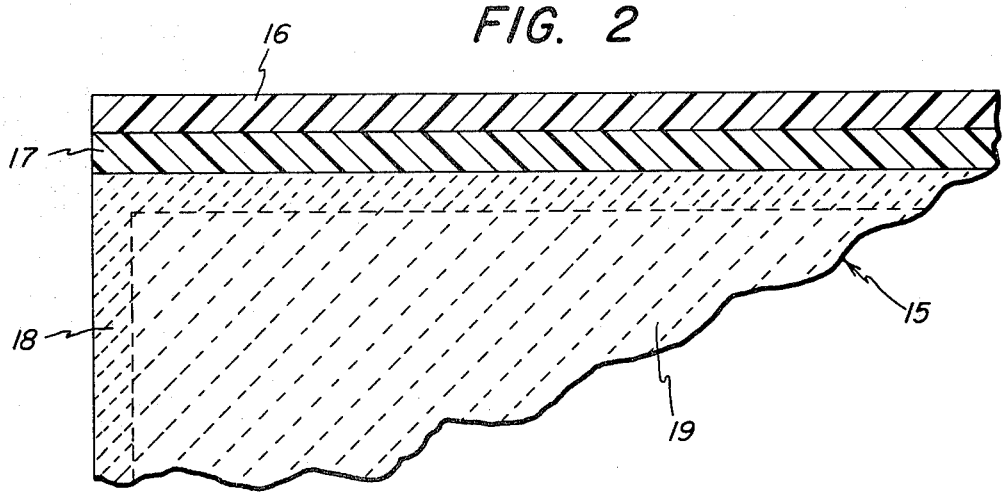
FIG. 2 is an enlarged, fragmentary, cross-sectional view of the surface portion of a brick covered by several layers of paint to be removed by the process in FIG. 1.
Figure 3:
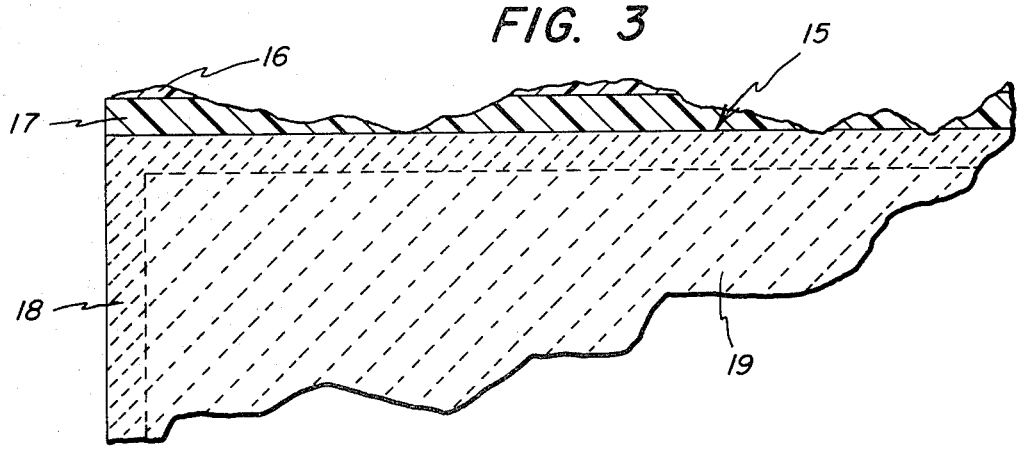
FIG. 3 is a view like that of FIG. 2 showing the same brick surface section following the heating and scraping steps of the process.
Figure 4:
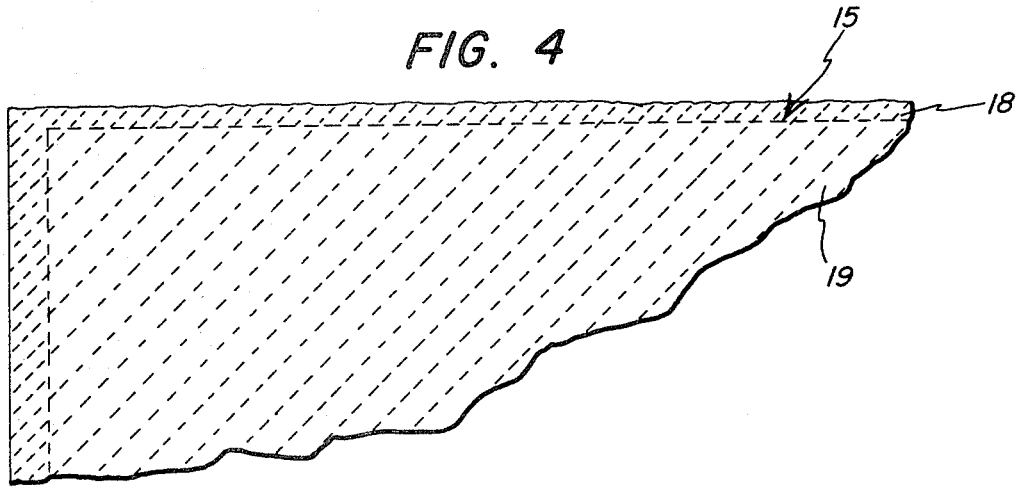
FIG. 4 is a view like that of FIGS. 2 and 3 showing a brick surface portion with paint removed by pressure grit washing, the bisque layer being lightly etched uniformly overall.

Changes in the surface of brick in the course of the present invention process are illustrated in FIGS. 2, 3 and 4 where at the outset brick 15 bears two coats 16 and 17 of paint on its top surface. Bisque layer 18 is shown as being continuous and fully surrounding and enveloping the pulp or interior body portion 19 of the brick. Then after flame heating and hot paint scraping the condition shown in FIG. 3 exists, most of paint layer 16 being removed and paint layer 17 being completely stripped away in a few places. Finally, when the pressure grit washing operation applied to the brick at the stage of FIG. 3 is completed, all of paint layers 16 and 17 have been removed and bisque layer to which the paint had been applied is left intact but thinned to a minor degree and lightly etched or surface roughened overall.

In using this process in the course of cleaning buildings very recently in the Albany, New York area, I have employed a twelve (12″) inch gun made specially for use with a pressure washer delivering a 1200 psi water spray thru either a 15 degree or a zero degree nozzle 10. This enabled me to get close to the brick surfaces to be cleaned to each case for the full height and width of the brick walls of the building and, using that water spray as a buffer for fine grit delivered at 90 psi from a ⅛ inch nozzle 13 held in my other hand, I was able to apply the grit over the brick surfaces moving it back and forth as required to effect complete removal of the paint without more than lightly etching the bisque of the bricks beyond the last traces of the paint. As shown in FIG. 5, nozzle 13 was fitted with a spring-loaded cut-off valve 13A which I used to interrupt the grit spray at intervals to clean the mask and for other purposes. The fine material of the abrasive spray was No. 1 grade silicon carbide which is commercially available under that designation through marketing outlets of Carborundum Company. On completion of the process, brick had the pinkish-orange pastel coloring characteristic of the Hudson River Commercial brick which was mass produced building material used extensively in the Albany region during the late 1800's and early 1900's. The ultimate cleaning result of this effort consequently was of pleasing appearance and it was accomplished without destructive effect upon the bricks of the wall structure and without substantially diminishing the life of the masonry construction.

It will be understood that the novel process of this invention may be applied to the cleaning as well as the removing of paint films and coatings from bricks and brick work in general. Thus, grime and dirt on unpainted brick surfaces may be removed to the depth necessary in superficial portions of the brick without destroying or breaking the continuity of the brick bisque layer protecting the internal structure and the structural integrity of the brick and the masonry structures consisting of it.

It will be understood in this connection that the preliminary steps of burning and scraping described above and illustrated in the drawings will not be necessary or perhaps desirable in the event that the brick to be cleaned does not bear paint coatings, or in the event that the paint is readily removable by pressure grit washing alone.

Having thus described this invention fully in compliance with the statutory requirements, I declare that what I am entitled to protect by patent grant is defined in what is claimed.

What is claimed:

1. The pressure grit washing process of removing paint from a brick surface without damaging the brick, said brick being of the type having a bisque, which comprises the steps of:

directing a stream of water, said stream having a longitudinal axis, at high velocity against the paint adhering to the brick;

directing a relatively low-velocity stream of fine particle abrasive material into the water stream from a nozzle while varying the angle and distance between the nozzle and the water stream, said angle ranging from 30° to 90° to the longitudinal axis thereof; and discontinuing contact of the water stream with the brick substantially as soon as the paint has all been removed from the brick surface.

2. The process of claim 1 in which the following steps are performed prior to the steps described therein:

heating the paint without igniting it; and scraping off the paint loosened by the heating step while the paint is still hot.

3. The process of claim 1 in which the abrasive material stream, using the water stream as a buffer, is traversed over the brick surface removing a substantially uniform thickness portion of the bisque of the painted surface.

4. The process of claim 3 in which the abrasive material stream is maintained at an angle of approximately 45° to the water stream.

5. The process of claim 1 in which the water stream is discharged under pressure of 1200 to 1500 pounds per square inch (psi) and the abrasive material stream is discharged under pressure 60 to 90 psi.

6. The process of claim 1 in which the water stream is directed against the painted brick surface before the abrasive material stream is introduced into the water stream and the nozzle of the abrasive material stream is moved toward and away from the water stream to increase and decrease paint removing action as necessary to accomplish the desired cleaning action and incidental light etching of the brick bisque.

* * * * *